US006875938B2

(12) United States Patent
Schmiz et al.

(10) Patent No.: US 6,875,938 B2
(45) Date of Patent: Apr. 5, 2005

(54) ILLUMINATED SWITCH ELEMENT

(75) Inventors: Marc Schmiz, Luxembourg (LU); Paul Schockmel, Mamer (LU); Aloyse Schoos, Bertrange (LU)

(73) Assignee: I.E.E. International Electronics & Engineering S.ar.l., Luxembourg (LU)

( * ) Notice: Subject to any disclaimer, the term of this patent is extended or adjusted under 35 U.S.C. 154(b) by 0 days.

(21) Appl. No.: 10/297,793

(22) PCT Filed: Jun. 8, 2001

(86) PCT No.: PCT/EP01/06511

§ 371 (c)(1),
(2), (4) Date: Dec. 9, 2002

(87) PCT Pub. No.: WO01/95357

PCT Pub. Date: Dec. 13, 2001

(65) Prior Publication Data

US 2004/0108193 A1 Jun. 10, 2004

(30) Foreign Application Priority Data

Jun. 9, 2000 (LU) ..... 90594

(51) Int. Cl.[7] ..... H01H 9/00; H01H 1/10; H01J 1/62

(52) U.S. Cl. ..... 200/310; 200/314; 200/512; 313/483

(58) Field of Search ..... 200/1 R–1 TK, 200/512–517, 308–317, 86 R, 86 A, 600; 341/22–35; 313/483–522

(56) References Cited

U.S. PATENT DOCUMENTS 4,532,395 A * 7/1985 Zukowski ..... 200/314
4,786,767 A * 11/1988 Kuhlman ..... 200/5 A
4,812,831 A 3/1989 Laier
5,669,486 A * 9/1997 Shima ..... 200/314
5,680,160 A * 10/1997 LaPointe ..... 345/173
6,069,444 A 5/2000 Krafcik et al.
6,100,478 A * 8/2000 LaPointe et al. ..... 200/314

FOREIGN PATENT DOCUMENTS

| | | |
|---|---|---|
| DE | 3816182 A1 | 11/1989 |
| EP | 0763838 A1 | 3/1997 |
| EP | 0986313 A2 | 4/2000 |
| JP | 10149737 | 8/1998 |
| JP | 10247434 | 9/1998 |
| JP | 11039984 | 2/1999 |

* cited by examiner

*Primary Examiner*—James R. Scott
(74) *Attorney, Agent, or Firm*—McCormick, Paulding & Huber LLP

(57) ABSTRACT

A foil style switching element includes a first carrier foil and a second carrier foil arranged at a certain distance from one another and a plurality of contact arrangement arranged between the first and the second carrier foils. The contact arrangements are arranged on the first and second carrier foils so that an electric contact between the contact arrangements is generated when the first and the second carrier foil are pressed together. A foil style luminescent screen unit applied on a side of the first carrier foil facing away from the second carrier foil, the luminescent screen unit includes a first electrode layer, a dielectric layer, a luminescent matter layer and a second electrode layer. The first electrode layer of the foil style luminescent screen unit is applied directly on the first carrier foil which faces away from the second carrier foil.

12 Claims, 1 Drawing Sheet

ILLUMINATED SWITCH ELEMENT

CROSS-REFERENCE TO RELATED APPLICATIONS

This application is entitled to the benefit of and incorporates by reference in their entireties essential subject matter disclosed in International Application No. PCT/EP01/06511 filed on Jun. 8, 2001 and Luxembourg Patent Application No. 90594 filed on Jun. 9, 2000.

FIELD OF THE INVENTION

The present invention relates to an illuminated switch element, in particular a foil style switch element.

BACKGROUND OF THE INVENTION

Foil style switch elements, such as membrane switches, foil pressure switches or similar elements, in general comprise at least two essentially elastic foil layers positioned at a certain distance from one another. This is effected, for example, by means of a spacer which is arranged around the active region of the switch element and to which the two foil layers are glued with their respective edges. In the active region of the switch element, various contact arrangements are attached to the foil layers, between which, when the two foil layers are pressed together, an electric contact is created, so that the switch element is triggered. When the pressure is released from the foil layers, these in turn are, due to their elasticity, restored to their spaced position and the electric contact between the various contact arrangements is interrupted.

Such a switch element has a very low assembly height and is in particular characterized by the multifarious possibilities of designing the command button. This makes such switch elements particular suitable for the use in fields where small structural dimensions and a flexible design of the command buttons is required.

When using switch elements in fields where varying light conditions have to be expected, switch elements are preferably designed such that their command button to be seen from the outside is illuminated from behind. With conventional switches, this background illumination often is achieved by the switch key of the switch being at least partly manufactured from transparent plastics and illuminated from behind by a filament lamp. Alternatively, the assembly space behind the switch key can be lightened via an optical fiber. Such an embodiment of the switch illumination, however, cannot be employed in a foil style switch element due to the desired low assembly height.

The document U.S. Pat. No. 4,812,831 describes an illuminated foil keyboard where a foil luminescent screen is applied on a foil keyboard. The foil keyboard comprises an upper carrier foil and a lower carrier foil being arranged at a certain distance from one another by means of a spacer. On the lower carrier foil, two electrode structures are applied in a spaced manner, which are contacted on actuation of the switch element by a layer of a conductive material applied on the bottom side of the upper carrier foil. On the top side of the upper carrier foil, first a screening grid of an electrically conductive ink is applied. On this screening grid, an adhesive layer is applied by which the luminescent screen unit is glued to the keyboard. The luminescent screen unit comprises a luminescent matter layer of a phosphorous material applied on a polyester layer and a plurality of electrodes arranged at the bottom side of this polyester layer.

Above the luminescent screen unit, a further foil inscribed with graphic symbols is arranged by means of an adhesive layer.

The document EP-A-0 996 131 describes an illuminated switch element having two carrier foils laminated together, between which contact arrangements are attached such that an electric contact between the contact arrangements is created when the carrier foils are pressed together. On the upper carrier foil, a luminescent screen unit is laminated by means of a spacer of a double-sided bonding sheet. The luminescent screen unit itself comprises a lower insulating foil, a first electrode layer, a dielectric layer, a luminescent matter layer, a second electrode layer and an upper transparent insulating layer which are applied to one another in this order.

The document U.S. Pat. No. 6,069,444 describes an input device having a printed circuit board on which a plurality of contact arrangements are applied.

Above the printed circuit board, a switching layer having several triggering elements is arranged, such that at least two of the contact arrangements are short-circuited by a triggering element when a vertical operating force strikes it. Above the switching layer, a luminescent screen unit is arranged. This luminescent screen unit comprises a lower carrier foil on which connection lines for a plurality of luminescent units are applied. The luminescent units comprise each from top to bottom a transparent carrier layer, a first transparent electrode layer, a luminescent matter layer, a dielectric layer and a lower electrode layer.

The document DE A-0 763 838 describes a membrane switch having a dome spring where a luminescent screen unit is applied within the dome spring on the top side of an insulating foil. The luminescent screen unit comprises a phosphorous layer and a dielectric layer.

SUMMARY OF THE INVENTION

It is consequently the object of the present invention to propose an illuminated foil style switch element.

According to the invention, this object is achieved by a switch element according to claim 1. Such a foil style switch element according to the invention comprises a first carrier foil and a second carrier foil arranged at a certain distance from one another. On the side of the first carrier foil facing away from the second carrier foil, at least one foil style luminescent screen unit is applied. According to the present invention, accordingly a foil style luminescent screen unit is applied outside of the switch element. In this case, the luminescent screen unit can, for example, be applied to the side of the switch element facing the user, so that with an electric drive of the luminescent screen unit, the side of the switch element facing the user is illuminated. In this manner, the command button of the switch element to be operated by the user can be easily located by the user even under bad light conditions. Alternatively, the luminescent screen unit can be applied to the side of the switch element facing away from the user, so that the switch element is illuminated from behind. In this case, for example, only the effective command button, or a certain, e.g. annular, region around the command button or a combination of both can be transilluminated from behind.

It should be noted that a foil style, flexible luminescent screen unit has a very small thickness, so that a switch element according to the invention is moreover characterized by a particularly small assembly height. Due to the high flexibility of such a foil style luminescent screen unit, moreover the response characteristic of the switch element is only slightly affected.

The foil style luminescent screen unit preferably comprises a capacitor structure having a dielectric luminescent matter embedded between two contactable electrode layers. When applying an electric alternating voltage between the two electrode layers, an electric alternating field is created which incites the luminous matter to radiate light.

The luminescent matter comprises in general a powdery substance which phosphoresces at a certain wavelength, such as phosphorous. Here, the color of the radiated light can be influenced via the composition of the luminescent matter.

In a preferred embodiment, the luminescent screen unit comprises a first electrode layer, a dielectric layer, a luminescent matter layer, and a second electrode layer which are applied to one another in this order. Here, the first electrode layer can, for example, be applied on a suitable carrier foil, while on the second electrode layer a transparent cover layer is applied. Such an element can, for example, be laminated onto the first carrier foil.

In a particularly advantageous embodiment, the first electrode layer is applied directly to the side of the first carrier foil facing away from the second carrier foil. By this arrangement, on the one hand the carrier foil of the luminescent screen unit can be dispensed with, on the other hand, when manufacturing the illuminated sensor, the step of laminating the luminescent screen unit onto the first carrier foil is omitted. In this context, it should be noted that the omission of the carrier foil of the luminescent screen unit leads to a reduction in the thickness of the switch element and an optimization of the triggering response.

In an advantageous embodiment where the luminescent screen unit is applied on the side of the switch element facing the user, the electrode layer facing away from the first carrier foil, i.e. the electrode layer later facing the user, is preferably transparent. This essentially increases the light efficiency of the illuminated switch element.

Such a transparent electrode layer comprises, for example, a suitable carrier foil which comprises a coating of indium-zinc-oxide or of a conductive polymer on the side facing the luminescent matter layer. In this case, the transparent electrode layer is, for example, laminated onto the luminescent matter layer.

In an alternative embodiment, the transparent electrode layer comprises a conductive material which is printed onto the luminescent matter layer. The conductive material can, for example, be applied onto the luminescent matter layer in the form of a conductive ink. Such an embodiment has the advantage that the application of the electrode layer e.g. in a screening process is very easy and can be effected, for example, with the same plants where the electrode structures of the switch element are applied onto the carrier foils.

It should be noted that the electrode layer applied to the first carrier foil of the switch element, too, is preferably printed onto the carrier foil. For example, it can comprise a printed silver layer or a graphite layer. The dielectric layer and the luminescent matter layer, too, can be printed onto the lower electrode layer in a screening process, the latter, for example, in the form of an ink containing luminescent matter. In this manner, the whole layer construction of the luminescent screen unit can be manufactured with screening plants, the handling of which is very well-known to the manufacturer of foil style switch elements.

Another advantage of printing the various layers is the flexibility with respect to the shaping of the individual layers. Thus, for example, the luminescent matter layer can be applied such that it has the shape of a graphic symbol which is assigned to a certain switch function, e.g. for actuating a window lifter in a vehicle. By doing so, a plurality of switch elements, which are arranged together in a switch module, can be individually characterized, so that the user can orient himself with the graphic symbols when he selects the command button associated with the desired switch function.

In an alternative embodiment, the luminescent matter layer comprises a plurality of individually drivable regions. With this embodiment, by a purposeful driving of certain regions of the luminescent matter layer, a graphic symbol or a picture information, respectively, can be represented which corresponds to a certain switch function. The regions of the luminescent matter layer to be individually driven are preferably arranged in a screen-shape in lines and columns, so that the luminescent screen unit represents a screen where, in response to the drive of certain regions, various symbols can be shown in illumination. Such an embodiment is particularly advantageous, if the switch function of a switch element can be changed as in a menu control.

It should be noted that, apart from the illustrated possibilities of characterizing the command button, there are further characterization variants. Thus, for example, a graphic symbol can be simply printed onto the transparent electrode layer or a cover layer disposed thereon by means of a dark ink. In this case, the symbol for the user can be recognized as a contrast in front of the illuminated background of the luminescent screen unit.

The actual switch element can, for example, be designed such that it operates in a so-called shunt mode. With such an embodiment, the switch element comprises two contact arrangements which are applied on one of the two carrier foils at a certain distance from one another, the contact arrangements being applied on the side of the carrier foil facing the other carrier foil. On the side of the other carrier foil facing the two contact arrangements, the switch element then comprises a triggering element, such that the triggering element brings into contact the two contact arrangements when the two carrier foils are pressed together.

In a simple variant of this embodiment, the triggering element comprises a simple conductive layer, e.g. made of silver. In this case, the switch element is a simple switch with two discrete conditions. In a preferred variant, however, the triggering element comprises a pressure-sensitive layer, e.g. made of a semiconductor material. In this variant, the switch element represents a pressure sensor, a so-called foil pressure sensor.

In another embodiment, the switch element has such a design that it operates in the so-called through-mode. In this embodiment, it comprises two contact arrangements, one of which each is applied to each of the two carrier foils, such that the two contact arrangements are facing each other and are brought into contact when the two carrier foils are pressed together. With this embodiment, too, the switch element can represent a simple discrete switch or a foil pressure sensor. In the latter case, for example, between the first and the second contact arrangement, a layer made of a pressure-sensitive material is arranged.

It should be noted that the switch element according to the invention is particularly suitable for the use in a switch module of a motor vehicle. In this field of application, in general all switch elements are illuminated, so that the driver can easily locate and operate the various command buttons even when driving during night.

Due to the constantly increasing demands on the design of the interior fittings, with modern vehicles, the assembly space available for the required switch elements is being reduced. Here, the switch elements according to the invention can fulfill the requirements better than the conventional switches due to their small thickness. Moreover, the flexibility of the switch elements according to the invention makes possible an adjustment of the switch elements to rounded shapes in the interior of the vehicle, so that altogether there will be new possibilities when using the switch elements according to the invention when a suitable assembly place for a required switch module is chosen.

Another advantage results from the fact that now illuminated pressure sensors are available. By the employment of such foil pressure sensors, completely new switch functions can be realized which have not been possible with the conventional switches. Thus, for example, the control of an electric window lifter where one side window opens faster in response to the pressure exerted on the associated switch, i.e. a foil pressure sensor, is possible. Another new switch function is enabled with the use of foil pressure sensors which are designed as linear potentiometers. Such a linear potentiometer comprises a pressure sensor strip which generates a signal which depends on the place of the triggering. With this switch element, a side window or a sliding roof can be opened up to a certain point depending on the place of the triggering of the sensor.

BRIEF DESCRIPTION OF THE DRAWINGS

In the following, an embodiment of the invention is described with reference to the enclosed FIG. 1, which represents a cross-section through an embodiment of an illuminated switch element.

DETAILED DESCRIPTION OF THE PREFERRED EMBODIMENT

Figure 1:
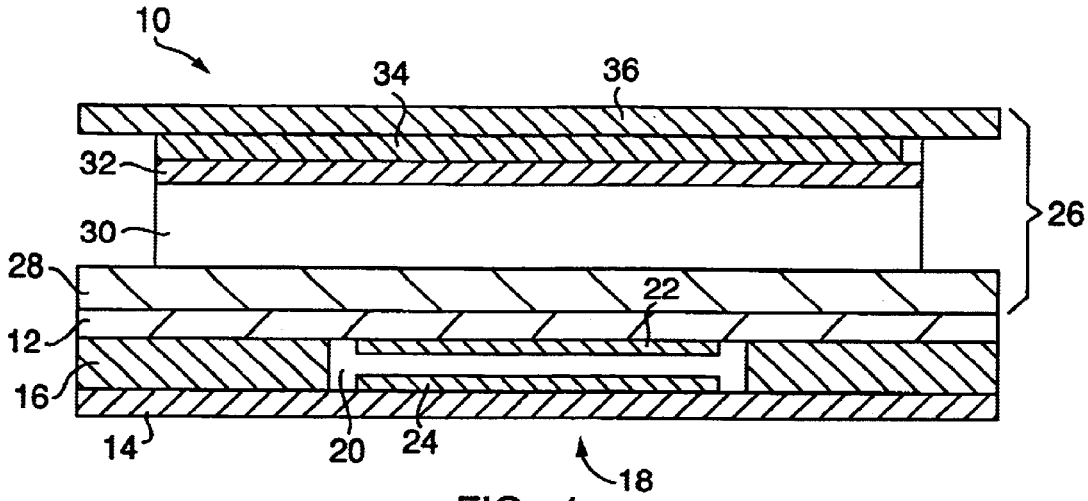

The switch element 10 comprises a first and a second carrier foil 12 and 14 being laminated together by means of a spacer 16, for example a double-sided bonding sheet. In the active region 18 of the sensor 10, the spacer 16 comprises a recess 20, so that in this region, the two carrier foils 12 and 14 are facing each other at a distance.

In the active region 18 of the sensor, contact arrangements 22 and 24 are arranged at the inside of the carrier foils 12 and 14, between which an electric contact is created when the two carrier foils are pressed together. The contact arrangements 22 or 24, respectively, can, for example, comprise electrode structures, at least one of the contact arrangements additionally comprising a layer of a pressure-sensitive material. The contact arrangements are, for example, applied onto the corresponding areas of the carrier foils in a screening process before the lamination of the carrier foils.

On the side of the first carrier foil 12 facing away from the second carrier foil 14, at least one luminescent screen unit 26 is applied to the first carrier foil. The same comprises a first electrode layer 28, e.g. of silver or graphite, which is directly applied on the first carrier foil 12. A dielectric is applied on the first electrode layer 28 in a layer 30 on which in turn a luminescent matter layer 32 is applied. A second electrode layer 34 is applied to the luminescent matter layer 32, so that a capacitor structure is formed in which, when an alternating voltage is applied, between the two electrode layers 28 and 34 an electric alternating field is generated which incites the luminescent matter to illuminate.

The thus manufactured capacitor structure is covered by means of a cover layer 36 which on the one hand electrically insulates the construction to the outside and on the other hand protects it from mechanical damage and environmental influences.

It should be noted that the layers 28 to 36 preferably are each applied to the respective layer below in a screening process. In a simple manner, such a method enables an individual design of the individual layers.

Figure 2:
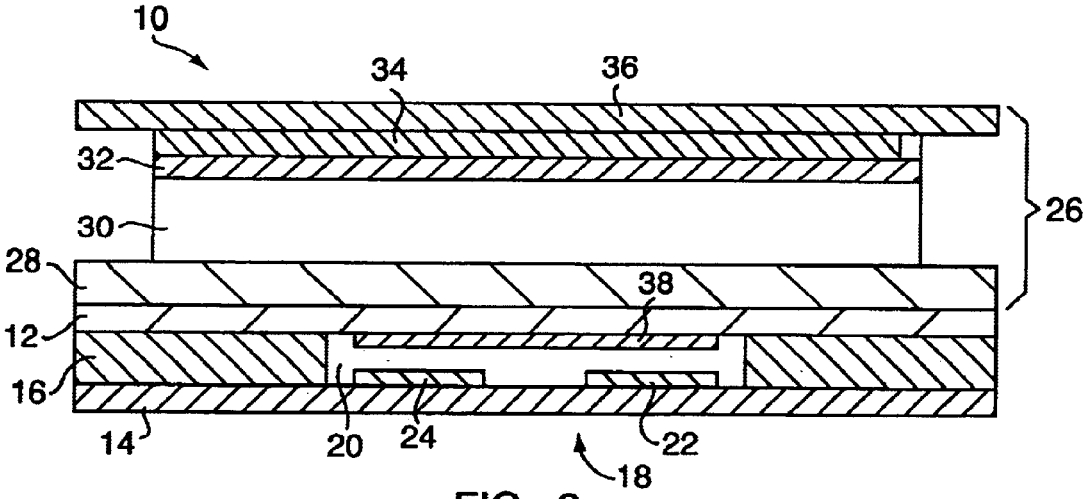
FIG. 2 illustrates a cross section through an illuminated switch element, in accordance with another embodiment of the present invention.

FIG. 2 illustrates a cross section through an illuminated switch element, in accordance with another embodiment of the present invention. As shown in FIG. 2, the contact arrangements 22 and 24 are both arranged upon one of the two carrier foils, 12 and 14, and particularly on carrier foil 14 in the embodiment of FIG. 2. A pressure sensitive triggering element 38 is also shown in FIG. 2. The pressure sensitive triggering element 38 is disposed on the other of the two carrier foils, 12 and 14, that do not support the contact arrangements, 22 and 24. Thus, the triggering element 38 will deform in accordance with applied pressure to bring into contact the two contact arrangements 22 and 24.

LIST IF REFERENCE NUMERALS

10 switch elements
12 first carrier foil
14 second carrier foil
16 spacer
18 active region
20 recess
22,24 contact arrangement
26 luminescent screen unit
28 first electrode layer
30 dielectric layer
32 luminescent matter layer
34 second electrode layer
36 cover layer

What is claimed is:

1. A foil style switching element comprising a first carrier foil and a second carrier foil arranged at a certain distance from one another, a plurality of contact arrangements arranged between the first and the second carrier foil, said contact arrangements being arranged on said first and second carrier foil so that an electric contact between the contact arrangements is generated when the first and the second carrier foil are pressed together, and a foil style luminescent screen unit applied on a side of the first carrier foil facing away from the second carrier foil, said luminescent screen unit comprising a first electrode layer, a dielectric layer, a luminescent matter layer and a second electrode layer, which are applied on one another in this order, wherein the first electrode layer of said foil style luminescent screen unit is applied directly on the side of the first carrier foil which faces away from said second carrier foil.

2. The switching element according to claim 1, wherein the foil style luminescent screen unit comprises a capacitor structure having a dielectric luminescent matter embedded between two contactable electrode layers.

3. The switching element according to claim 2, wherein the luminescent matter layer comprises a phosphorous layer.

4. The switching element according to claim 1, wherein the second electrode layer is transparent.

5. The switching element according to claim 4, wherein the transparent electrode layer comprises a suitable carrier foil, said carrier foil comprising at the side facing the luminescent matter layer a coating of indium-zinc-oxide or of a conductive polymer, the transparent electrode layer being laminated onto the luminescent matter layer.

6. The switching element according to claim 4, wherein the transparent electrode layer comprises a conductive material which is printed onto the luminescent matter layer.

7. The switching element according to claim 1, wherein the luminescent screen unit comprises a protective layer on the side facing away from the first carrier foil.

8. The switching element according to claim 1, comprising two contact arrangements, said contact arrangements being applied on one of the two carrier foils at a certain distance from one another, the contact arrangements being applied on a side of the carrier foil which faces the other carrier foil, and a triggering element comprising a conductive material which is applied on the side of the other carrier foil facing the two contact arrangements in such a way that said triggering element brings into contact the two contact arrangements when the two carrier foils are pressed together.

9. The switching element according to claim 8, wherein the triggering element comprises a pressure-sensitive layer.

10. The switching element according to claim 1, comprising two contact arrangements one of which is applied to each of the two carrier foils, such that the two contact arrangements are facing each other and are brought into contact when the two carrier foils are pressed together.

11. The switching element according to claim 10, wherein a layer made of a pressure-sensitive material is arranged between the first and the second contact arrangement.

12. The switching element according to claim 1, wherein said switching element is incorporated into a motor vehicle.

* * * * *

UNITED STATES PATENT AND TRADEMARK OFFICE

CERTIFICATE OF CORRECTION

PATENT NO. : 6,875,938 B2 
DATED : April 5, 2005
INVENTOR(S) : Marc Schmiz, Paul Schockmel and Aloyse Schoos It is certified that error appears in the above-identified patent and that said Letters Patent is hereby corrected as shown below:

Title page,
Item [57], ABSTRACT,
Line 3, after "plurality of contact", please delete "arrangement" and insert -- arrangements --.

Signed and Sealed this

Fifth Day of July, 2005

JON W. DUDAS
*Director of the United States Patent and Trademark Office*